US006260207B1

(12) United States Patent
Barbeau et al.

(10) Patent No.: US 6,260,207 B1
(45) Date of Patent: Jul. 17, 2001

(54) SHROUD FOR WEARING WITH PROXIMITY FIRE FIGHTING PROTECTIVE GARMENTS

(75) Inventors: Claude Barbeau, St-Bruno; Josée Casaubon, Laval, both of (CA)

(73) Assignee: Marcanada Inc., Montréal (CA)

( * ) Notice: Subject to any disclaimer, the term of this patent is extended or adjusted under 35 U.S.C. 154(b) by 0 days.

(21) Appl. No.: 09/589,372

(22) Filed: Jun. 8, 2000

(51) Int. Cl.[7] ..... A42B 1/04
(52) U.S. Cl. ..... 2/202; 2/458; 2/5; 2/7
(58) Field of Search ..... 2/458, 457, 459, 2/461, 467, 5, 7, 8, 422, 468, 63, 84, 202, 206, 207, 200.1, 906

(56) References Cited

U.S. PATENT DOCUMENTS 4,184,212 * 1/1980 Bowman ..... 2/5
4,602,385 * 7/1986 Warren ..... 2/2.14
5,309,571 * 5/1994 Huang ..... 2/458
5,628,065 * 5/1997 Austin ..... 2/81
5,873,132 * 2/1999 Grilliot et al. ..... 2/84
6,006,360 * 12/1999 Reed ..... 2/202

* cited by examiner

*Primary Examiner*—John J. Calvert
*Assistant Examiner*—Robert H. Muromoto, Jr.
(74) *Attorney, Agent, or Firm*—Swabey Ogilvy Renault

(57) ABSTRACT

The shroud is made of a radiant-heat reflecting and thermo-insulating fabric material and is shaped to cover the shoulders, upper chest and back of a firefighter, and to be worn with a firefighting proximity garment. The shroud has a lower edge reaching the upper chest and back of the firefighter, and a continuous upper edge extending to the helmet outer cover. A face opening is provided in the shroud opposite the face piece when the shroud is worn over the firefighting protective garment. The face opening can be adjusted to the dimension of the face piece and is arranged to prevent the formation of gaps in protection between the face piece and the periphery of the face opening. The shroud can be fixed to the helmet outer cover at the continuous upper edge so as to prevent heat from penetrating into the firefighting protective garment between the helmet and the helmet outer cover.

13 Claims, 2 Drawing Sheets

SHROUD FOR WEARING WITH PROXIMITY FIRE FIGHTING PROTECTIVE GARMENTS

BACKGROUND OF THE INVENTION (a) Field of the Invention

The present invention relates to a shroud for wearing with proximity fire fighting protective garments. More specifically, this invention relates to an aluminized shroud to be worn with proximity firefighting protective garments and helmet. More particularly, the invention is concerned with the provision of an opening in the shroud so as to accommodate a variety of face pieces of different SCBA (self-contained breathing apparatus) while meeting the dimensional requirements of the 2000 edition of NFPA 1976 (National Fire Protection Association). As well, the invention is concerned with the provision of a front closure system enabling the shroud to be easily donned and doffed, such that the wearer does not have to align the right and left sides in order to close it and have a continuous seal of the right half with the left, and that there is no chance of the right and left sides inadvertently separating.

(b) Description of Prior Art

National Fire Protection Association (NFPA) standard 1976 dictated the design and performance requirements for helmets, trousers and coats intended for proximity fire fighting. However, until the publication of the 2000 edition of NFPA 1976, there was no standard governing the design and performance of shrouds used for proximity fire fighting.

Until the publication of the 2000 edition of NFPA 1976 there currently existed two types of shroud used with proximity protective clothing. One was an aluminized hood with built-in radiant-heat reflecting visor that covers the entire head, shoulders, upper back and upper chest. This design of shroud is claustrophobic and restricts peripheral vision clearance. This design has fallen into disfavor.

The second type of shroud is a single layer of aluminized fabric (now multiple layers of material of which one is aluminized fabric) attached to the helmet suspension system. This shroud drapes over the shoulders and the upper chest and back of a firefighter. All of the various manufactured shrouds of this second type have left and right sides that overlap and close at the front by means of hook and pile fastener tape. The completeness of the seal of two sides depends on the attention the wearer pays when aligning the two sides and the corresponding hook and pile fasteners. Occasionally the two sides would not be properly aligned and closed. As a result, there could be gaps in the protection offered by the shroud or the two sides could separate during the rigors of proximity fire fighting.

Furthermore, since there was no standard governing the dimensions of the face opening, the manufacturer was at liberty to design the face opening of the shroud with the dimensions it chose. It was not uncommon to have a gap in protection between the SCBA face piece and the edge of the face opening in the shroud.

With the publication of the 2000 edition of NFPA 1976, it is now necessary for the shroud to meet stringent design and performance requirements. In particular, NFPA dictates that the face opening shall measure 5⅝ inches (+0/−1 inch) in any direction or, if designed to be worn with a specific SCBA face piece, shall overlap the outer edge of the specific SCBA face piece-to-face seal perimeter by not less than ½ inch.

As a consequence, it is more difficult to ensure that the shroud face opening interfaces with the SCBA face piece.

Since there are at least seven different brands of SCBA commonly used in proximity fire fighting—each with its own design of face piece—it has almost become necessary to have one design of shroud for each brand of SCBA face piece.

Furthermore, NFPA 1976 requires the shroud itself to have a thermal protective performance rating of at least 35. In order to achieve this level of thermal performance, it is necessary for the shroud to be constructed of either a single layer of thermal reflective and insulating material or of multiple layers of thermal insulating and reflective material. The thicker single layer or multiple layers produce a shroud that is stiffer than the earlier versions.

Another consequence of the stiffer shrouds is that it has become more difficult to both align and securely close the two halves of the shroud with hook and pile fastener. As well, it is more likely that the front opening of the shroud accidentally gapes during the rigors of proximity fire fighting.

Another disadvantage of this second type of shroud is that it is normally attached to the helmet with the consequence that radiant heat easily penetrates through the gap between the shroud and the helmet outer cover and may produce real discomfort to the firefighter.

SUMMARY OF INVENTION

It is therefore an object of the present invention to provide a proximity shroud that interfaces with a variety of SCBA face pieces in compliance with the interface requirements of NFPA 1976.

It is another object of the present invention to provide a shroud that is ergonomically designed to minimize the loss of flexibility resulting from the TPP requirement (Thermal Protective Performance).

It is yet another object of the present invention to have a shroud whose left and right sides close securely by means of a slide fastener.

It is another object of the present invention to remove the need to align the right and left sides of the shroud before closing.

In accordance with the invention, there is provided a shroud to be worn as part of a proximity firefighting protective ensemble, said ensemble including coat and trousers, a helmet, a helmet outer cover. gloves and boots, and a SCBA face piece, said shroud interfacing with said SCBA face piece, and said shroud comprising at least one layer of radiant heat-reflecting and thermo-insulating fabric material, said shroud being shaped to substantially cover shoulders, upper chest and back of a firefighter and to be worn with said proximity firefighting protective ensemble, said shroud having a continuous lower edge reaching said upper chest and back, and a continuous upper edge extending to said helmet outer cover, a face opening provided in said shroud to be disposed opposite said face piece when said shroud is worn with said firefighting protective ensemble, said face opening having a periphery formed with means to cause said face opening to adjust to dimension of said face piece and to prevent formation of gaps in protection between said face piece and the periphery of said face opening, means to fix said shroud to said helmet outer cover at said continuous upper edge in a manner to prevent heat from penetrating into said firefighting protective ensemble between said shroud and said helmet outer cover.

According to a preferred embodiment, the shroud has a vertical front opening provided between a lower end of the face opening and the continuous lower edge, the vertical opening being arranged to prevent complete separation of the shroud at a chest portion thereof, to permit easy donning and doffing of the shroud, and means to fasten the vertical front opening after donning the shroud, and to unfasten the vertical front opening for doffing the shroud.

According to another preferred embodiment, the shroud according to the invention comprises snapping means associated with the helmet outer cover at a lower periphery thereof and with the shroud at the continuous upper edge, to fix the shroud to the helmet outer cover.

According to yet another preferred embodiment, the shroud comprises a plurality of snap hooks, distributed along the outer periphery of the helmet outer cover, and a plurality of corresponding snap heads distributed along the upper edge of the shroud, the snap hooks capable of engaging the snap heads to fix the shroud to the helmet outer cover.

The fabric material is preferably aluminized on its surface to reflect radiant heat.

In accordance with another preferred embodiment, the periphery of the face opening is provided with a resilient material, such as an elastic band, enabling the face opening to resiliently extend and retract to adjust to the dimension of the face piece.

In accordance with yet another preferred embodiment, the vertical front opening divides the chest portion of the shroud into a right chest part and a left chest part, the shroud comprising means to prevent misalignment of the right and left parts when fastening the vertical front opening.

Preferably, the vertical front opening stops short of the continuous lower edge to prevent complete separation of the right part from the left part thereby preventing misalignment thereof when fastening the vertical front opening.

The fastening and unfastening means for the vertical front opening preferably comprise a slide fastener, which is arranged to spread the right and left parts but which prevents complete separation thereof at the lower ends thereof.

In accordance with another preferred embodiment, one of the right or left part is formed with a flap along the vertical front opening, the flap being constructed to cover the slide fastener when the latter is in fastened position, thereby preventing heat from reaching inside the shroud through the slide fastener. In addition, the right chest part may overlap the left chest part when fastening the slide fastener, thereby further preventing heat from reaching inside the shroud through the slide fastener.

In accordance with yet another preferred embodiment, the shroud comprises the above right chest part and left chest part, a right shoulder piece and a left shoulder piece, and a back and neck piece, the right shoulder piece being sewn to the back and neck piece and part of the right chest part, the left shoulder piece being sewn to the back and neck piece and part of the left chest part, the back and neck piece being also sewn to part of the right and left chest parts.

BRIEF DESCRIPTION OF DRAWINGS

This invention is illustrated but is not limited to the embodiment which is described in the annexed drawings in which.

DESCRIPTION OF PREFERRED EMBODIMENT

Figure 1:
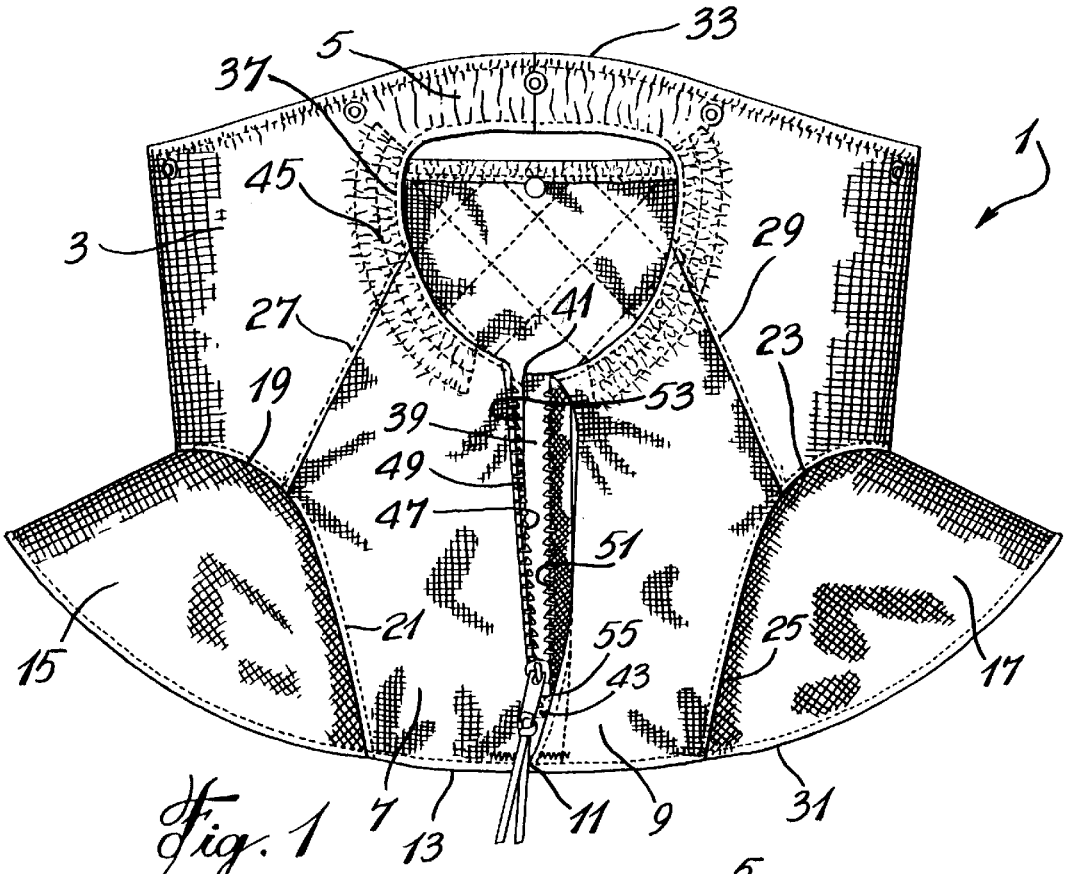
FIG. 1 is a front view of a shroud according to the invention.

Referring to the drawings, it will be seen that the shroud 1 which is illustrated consists of a back and neck piece 3 which is shaped as illustrated to cover the upper back, the rear and sides of the neck, and the head of a firefighter. It should also be noted that back and neck piece 3 is continuous in the upper part thereof by having an integral strip 5 which covers the area of the forehead of a firefighter. The shroud also consists of a chest piece which is formed of a right chest part 7 and a left chest part 9, the two parts being joined together at 11 by having a common bottom edge 13. It is indeed essential to have such joining of parts 7 and 9 to prevent any misalignment of chest parts 7 and 9 when donning and doffing the shroud. Any means to achieve this purpose is within the scope and spirit of the present invention. Shroud 1 also comprises right shoulder piece 15 and left shoulder piece 17. All these parts are sewn together (or assembled together by any means known to those skilled in the art) as shown. More particularly, right shoulder part 15 is sewn to back and neck piece 3 at 19, and to right chest part 7 at 21, while left shoulder piece 17 is sewn to back and neck piece 3 at 23, and to left chest part 9 at 25. In turn, back and neck piece 3 is also sewn to right chest part 7 at 27, and to left chest part 9 at 29. Of course, the particular way in which the various parts are sewn together is not part of the present invention and is entirely left to one skilled in the art. The only requirement is that once the parts constituting the shroud are assembled together, the shroud according to the invention should have the properties of being radiant heat reflecting and thermo-insulating.

Figure 3:
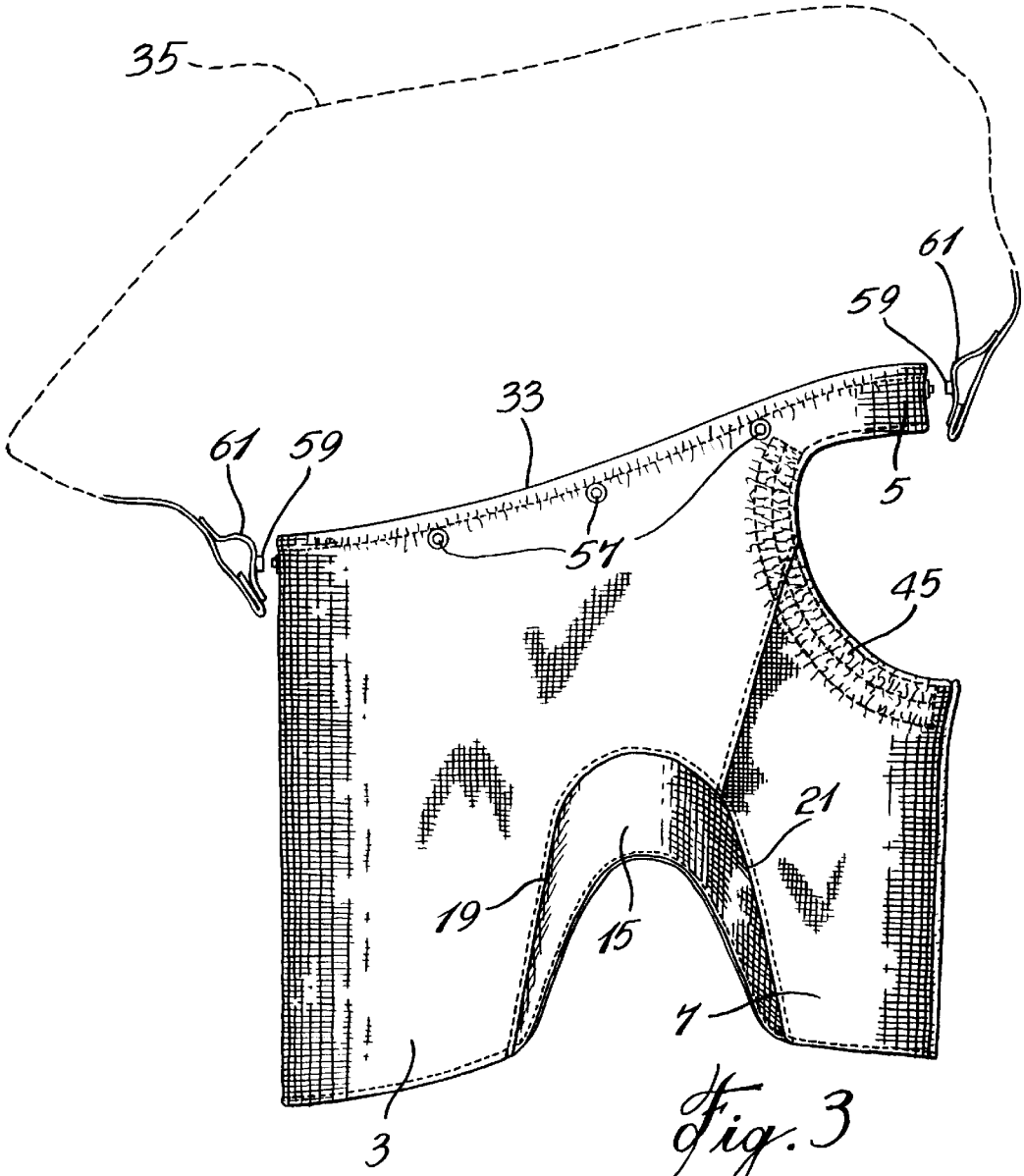
FIG. 3 is a side view of the same shroud particularly showing its attachment to a helmet outer cover illustrated in dotted line.

All in all, once assembled, the shroud should have a continuous lower edge 31 which generally reaches the upper chest and upper back of a firefighter, as well as his upper arms. The shroud also has a continuous upper edge 33 which reaches the border of the helmet outer cover 35 (as shown in FIG. 3), which is worn by a firefighter over his helmet (not shown). The various parts of the shroud are shaped in such a manner that they provide a face opening 37 in the shroud, to be disposed opposite the face piece (not shown) of a firefighter's SCBA, when it is worn over his protective garment (not shown). The formation of face opening 37 is made possible by providing suitable cut out portions in back and neck piece, and right and left chest parts 7 and 9. More details with respect to face opening 37 will be described later.

To ensure that lower edge 31 is continuous and thereby to prevent a possible misalignment of right chest part 7 relative to left chest part 9 (when donning the shroud), which is an essential characteristic of the invention, in the illustrated embodiment, right chest part 7 and left chest part 9 are sewn together where they meet at the middle front of lower middle extremity 11. The shroud 1 is provided with a vertical opening extending from the face opening 37 to the joining point 11 of the left and right chest parts 7 and 9. It will also be realized that this vertical opening 39 extends from the lowermost point 41 of opening 37 to a point 43 short of continuous lower edge 31. In this manner, when donning the shroud, right chest part 7 and left chest part 9 are always aligned with respect to one another.

Turning now to opening 37, it is pointed out that it is shaped to adjust in size to a multiplicity of face piece sizes.

To achieve this, the size of face opening 37 is such that its periphery overlaps the outer edge of the smallest size face piece presently available by not less than 12 inch, to meet the requirements of NFPA 1976. Of course, when the face piece is larger, this becomes a problem as it would be desirable to then have a shroud with a larger opening. According to the present invention, in order to prevent the formation of a gap between the face piece and the periphery of face opening 37, there is inserted an elastic band 45 all along the periphery of face opening 37. In its retracted position, the elastic band will cause face opening 37 to be perfectly adjusted to the smallest size face piece which is presently available. When the face piece is larger, it is merely necessary to extend the periphery of face opening 37 which is made possible by extending elastic band 45. Of course any other means to cause the periphery of opening 37 to be resilient is within the scope and spirit of the present invention.

Figure 2:
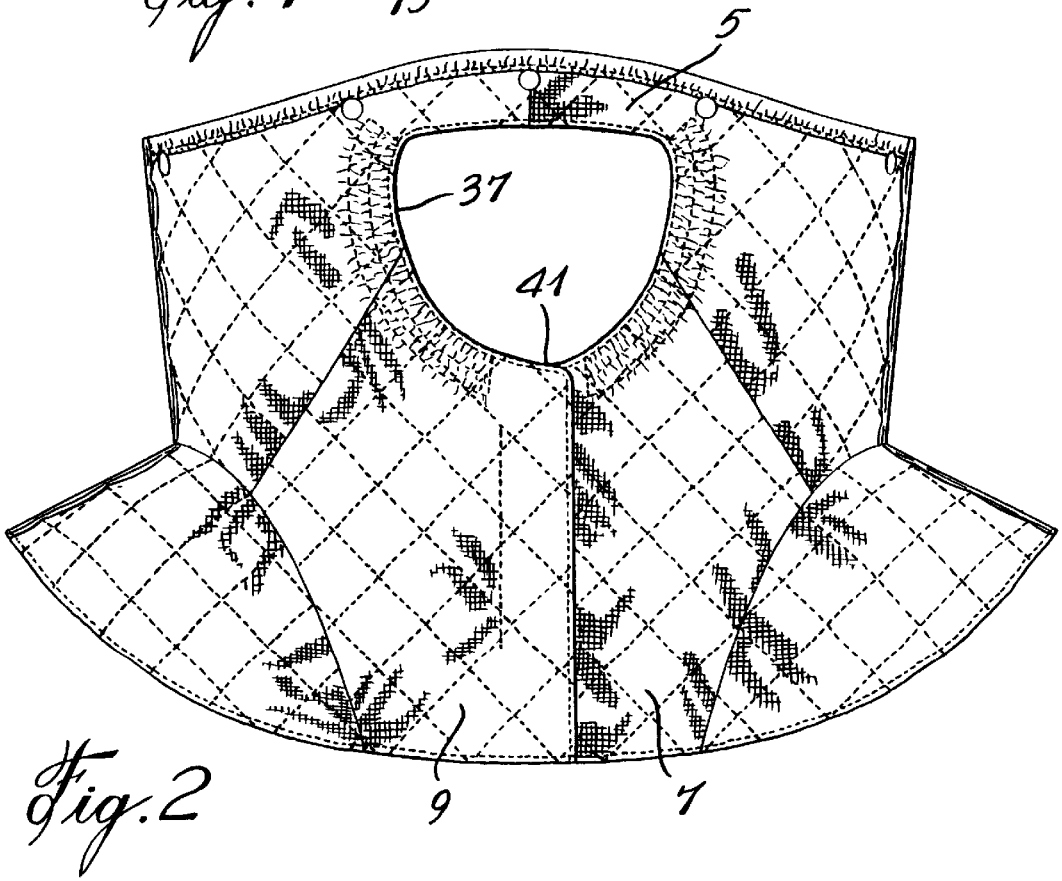
FIG. 2 is a view taken from the inside of the shroud illustrated in FIG. 1.
Figure 4:
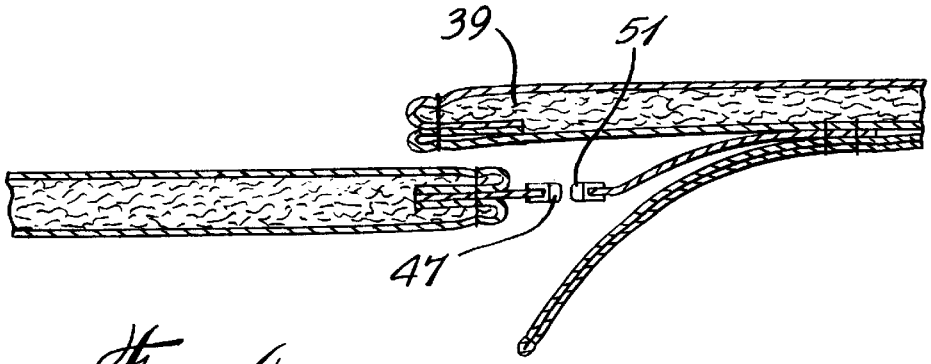
FIG. 4 is a cross-section view of the closure system at the front of the shroud.

It was mentioned above that a vertical opening 39 is provided between right chest part 7 and left chest part 9. To make sure that no heat penetrates through opening 39 when the latter is fastened, vertical opening 39 is provided with a slide fastener of the Zipper® type. More particularly, right toothed strip 47 is fixed along vertical edge 49 of the right chest part 7 while left toothed strip 51 is slightly offset with respect to the vertical edge 53 as shown in FIGS. 1 and 4 so that in fastened position of right and left chest parts 7 and 9, right chest part 7 overlaps left chest part 9 as shown in FIGS. 2 and 4. To additionally prevent any heat penetration, a flap 55 is fixed along the inside of vertical edge 53 to overlap the slide fastener.

Finally, it is one of the features of the present invention to prevent heat from penetrating between helmet outer cover 35 and the helmet (not shown). To achieve this, a plurality of snapping heads 57 are distributed on the outer face of shroud 1 along continuous upper edge 33 as illustrated in FIG. 3. Correspondingly, a plurality of snapping hooks 59 are attached to the inner lower portion of helmet outer cover 35 by means of attachments 61. So, after donning the shroud, it is merely necessary to snap it to helmet outer cover as indicated. Of course, any other suitable attachment means for the shroud is within the scope and spirit of the present invention.

The shroud according to the invention gives a full protection against radiant heat and is fully thermo-insulating under normal circumstances.

Of course, modifications are possible within the spirit and scope of the present invention as defined in the appended claims.

We claim:

1. A shroud to be worn as part of a proximity firefighting protective ensemble, said ensemble including coat and trousers, a helmet, a helmet outer cover, gloves and boots and a SCBA face piece, said shroud comprising at least one radiant-heat reflecting and thermo-insulating fabric material, said shroud being shaped to substantially cover shoulders, upper chest and back of a firefighter and to be worn with said proximity firefighting protective ensemble, said shroud having a continuous lower edge reaching said upper chest and back, and a continuous upper edge extending to said helmet outer cover, a face opening provided in said shroud to be disposed opposite said face piece when said shroud is worn over said firefighting protective ensemble, said face opening having a periphery formed with means to cause said face opening to adjust to dimension of said face piece and to prevent formation of gaps in protection between said face piece and the periphery of said face opening, means to fix said shroud to said helmet outer cover at said continuous upper edge in a manner to prevent heat from penetrating into said firefighting protective ensemble between said shroud and said helmet outer cover.

2. Shroud according to claim 1, wherein said shroud has a vertical front opening provided between a lower end of said face opening and said continuous lower edge, said vertical opening arranged to prevent complete separation of said shroud at a chest portion thereof, to permit easy donning and doffing of said shroud, and means to fasten said vertical front opening after donning said shroud, and to unfasten said vertical front opening for doffing said shroud.

3. Shroud according to claim 2, which comprises snapping means associated with said helmet outer cover at a lower periphery thereof and with said shroud at said continuous upper edge, to fix said shroud to said helmet outer cover.

4. Shroud according to claim 3, which comprises a plurality of snap hooks, distributed along the outer periphery of said helmet outer cover, and a plurality of corresponding snap heads distributed along the upper edge of said shroud, said snap hooks capable of engaging said snap heads to fix said shroud to said helmet outer cover.

5. Shroud according to claim 1, wherein said fabric material is aluminized on an surface thereof to reflect radiant heat.

6. Shroud according to claim 1, wherein the periphery of said face opening is provided with a resilient material enabling said face opening to resiliently extend and retract to adjust to the dimension of said face piece.

7. Shroud according to claim 6, wherein said resilient material comprises an elastic band.

8. Shroud according to claim 2, wherein said vertical front opening divides said chest portion of said shroud into a right chest part and a left chest part, said shroud comprising means to prevent misalignment of said right and left parts when fastening said vertical front opening.

9. Shroud according to claim 8, wherein said vertical front opening stops short of said continuous lower edge to prevent complete separation of said right part from said left part thereby preventing misalignment thereof when fastening said vertical front opening.

10. Shroud according to claim 9, wherein said fastening and unfastening means for said vertical front opening comprise a slide fastener, which is arranged to spread said right and left parts but which prevents complete separation thereof at lower ends thereof.

11. Shroud according to claim 10, wherein one said right or left part is formed with a flap along said vertical front opening, said flap constructed to cover said slide fastener when the latter is in fastened position, thereby preventing heat from reaching inside said shroud through said slide fastener.

12. Shroud according to claim 11, wherein said right chest part overlaps said left chest part when fastening said slide fastener, thereby further preventing heat from reaching inside said shroud through said slide fastener.

13. Shroud according to claim 2, wherein said shroud comprises said right chest part and said left chest part, a right shoulder piece and a left shoulder piece, and a back and neck piece, said right shoulder piece being sewn to said back and neck piece and part of said right chest part, said left shoulder piece being sewn to said back and neck piece and part of said left chest part, said back and neck piece being also sewn to part of said right and left chest parts.

* * * * *

UNITED STATES PATENT AND TRADEMARK OFFICE

CERTIFICATE OF CORRECTION

PATENT NO. : 6,260,207 B1 
DATED : July 17, 2001
INVENTOR(S) : Claude Barbeau and Josée Casaubon It is certified that error appears in the above-identified patent and that said Letters Patent is hereby corrected as shown below:

Column 5,
Line 3, replace "12 inch" by -- 1/2 inch --
Line 52, remove "and a SCBA face piece"

Column 6,
Line 26, replace "an surface" by -- a surface --

Signed and Sealed this

Ninth Day of September, 2003

JAMES E. ROGAN
*Director of the United States Patent and Trademark Office*